US005546994A

United States Patent [19]

Sarfati

[11] Patent Number: 5,546,994

[45] Date of Patent: Aug. 20, 1996

[54] THREAD STORAGE DRUM WITH FRUSTOCONICAL BRAKE STRIP

[75] Inventor: Alberto G. Sarfati, Como, Italy

[73] Assignee: Sobrevin Société de brevets industriels-Etablissement, Vaduz, Liechtenstein

[21] Appl. No.: 324,099

[22] Filed: Oct. 14, 1994

[51] Int. Cl.[6] ..... D03D 47/36

[52] U.S. Cl. ..... 139/452; 139/194; 242/47.01

[58] Field of Search ..... 139/452, 194; 242/47.01

[56] References Cited

U.S. PATENT DOCUMENTS

| | | | |
|---|---|---|---|
| 3,971,522 | 7/1976 | Pfarrwaller | 139/452 X |
| 4,068,807 | 1/1978 | Jacobsson | 139/452 X |
| 4,434,609 | 3/1984 | Schacht | 242/47.01 X |
| 4,744,394 | 5/1988 | Lincke | 139/452 |
| 4,799,517 | 1/1989 | Bucher | 139/452 |
| 4,926,912 | 5/1990 | Zenoni | 139/452 |
| 5,181,544 | 1/1993 | Deivri | 139/4 |
| 5,343,899 | 9/1994 | Jacobsson et al. | 139/452 |
| 5,409,043 | 4/1995 | Zenoni et al. | 139/452 |

FOREIGN PATENT DOCUMENTS

| | | |
|---|---|---|
| 328993 | 4/1976 | Austria . |
| 243565 | 11/1987 | European Pat. Off. . |
| 0330951 | 9/1989 | European Pat. Off. . |
| 446447 | 9/1991 | European Pat. Off. . |
| 0534263 | 3/1993 | European Pat. Off. . |

*Primary Examiner*—Andy Falik
*Attorney, Agent, or Firm*—Martin A. Farber

[57] ABSTRACT

A thread storage (1) having a substantially cylindrical storage drum (2) for the receiving and delivery of circumferentially deposited turns of thread (3), having a central thread withdrawal eye (4) for the overhead withdrawal of the thread (5), and having a brake surface (8) which rests under spring load on a frustoconical withdrawal slide surface (6) associated with the withdrawal-side end region (2') of the drum, which brake surface is formed by the inner side of a frustoconical brake strip (9) of flexible material. In order to make the withdrawal of the thread uniform and counteract wear and deformation of the brake surfaces, the frustoconical brake strip (9) rests flushly on the frustoconical withdrawal slide surface (6), the thread being withdrawn tangentially through the flushly engaging surfaces.

22 Claims, 5 Drawing Sheets

THREAD STORAGE DRUM WITH FRUSTOCONICAL BRAKE STRIP

FIELD AND BACKGROUND OF THE INVENTION

The present invention relates to a thread storage.

A thread storage is known from European Patent 0 534 263. The thread storage disclosed there has a substantially cylindrical storage drum onto the circumference of which thread turns can be deposited. The supply of thread deposited there can be withdrawn from the top through a central withdrawal eye. In order that the thread can be withdrawn with a given thread tension, a thread brake is provided there. A brake strip of a flexible material is fastened there on a holding member having the shape of a truncated cone, the inner side of the strip resting under spring tension on a withdrawal slide surface at the region of the end of the drum. In the case of this thread storage, the thread is clamped between the withdrawal slide surface and the brake surface of the brake strip. In the known thread storage, the funnel-shaped brake surface lies on a curved withdrawal slide surface on the region of the end of the drum. The contact surfaces between brake surface and withdrawal slide surface are in this case minimal. The brake strip is acted on substantially only linearly. This has the result that in the course of time a washboard-like undulated structure which extends in circumferential direction is imparted to the brake strip due to the withdrawal of the thread. Uniform withdrawal of the thread is no longer possible with a brake strip which has been damaged in this way.

SUMMARY OF THE INVENTION

The object of the invention is therefore so to improve a thread storage of this type that the withdrawal of the thread is improved.

As a result of the development in accordance with the invention, the contact surface between brake surface and withdrawal slide surface has been considerably increased, The contract surface now has the shape of the surface of a truncated cone, The opening angle of the funnel-shaped brake surface corresponds in this connection to the angle of the frustoconical withdrawal slide surface, The thread is pulled between the flush application between the braking surface of the brake strip and the withdrawal slide surface, The withdrawal of the thread preferably takes place in such a manner that it leaves the thread brake in direction tangential to the withdrawal slide surface, This result is preferably achieved in the manner that the thread withdrawal eye is located in the region of the theoretical tip of the cone of the withdrawal slide surface. In this way, assurance is had that the force with which the brake strip rests on the storage drum is independent of the tension of the thread. This results in a constant thread tension. A preferred further development of a thread storage of this type for reducing an evading movement of the holding member provides for an intermediate layer of elastic material between the holding member and the brake strip. As a result of this development, the evading movement of the thread brake upon the withdrawal of the thread passing between the engaging surfaces of the brake strip and drum is effected substantially only by the brake strip. The brake strip itself can consist of highly flexible material as a result of the intermediate layer of elastic material. The intermediate layer preferably consists of a foam body. If the holding surface of the holding member extends parallel to the brake strip, then the intermediate layer has a substantially rectangular cross section. The radial width of the foam body can in this connection be somewhat less than the radial width of the brake strip. The thickness of the intermediate layer is preferably less than the width of the brake strip but greater than the largest possible size of thread which can be stored. The elastic intermediate layer between holding member and brake strip has the advantage that, upon removal of the thread, the brake strip can move away locally in the direction towards the holding member. The evading movement can thus take place in the direction of the normal to the surface of the brake strip. In European Patent 0 330 951, there has already been proposed an evasion movement of brake strip elements perpendicular to a brake surface or brake counter surface. In that case, the brake elements are formed of laminas. A continuous constantly smooth, brake surface is more advantageous. For the precise adjusting of the force with which the brake strip rests on the edge of the drum, it is provided that the holding member is spring biased in axial direction. The brake strip is preferably formed of a thin metal strip which is smooth on its inside and the thickness of which is preferably less than 0.1 mm. Since the brake strip preferably need not itself contribute to the stability in shape of the braking arrangement, it can be highly flexible, formed preferably from a thin metal foil. In order to adjust the force with which the brake ring rests on the end region of the drum, the axial spring action of the holding member is adjustable. The spring path of the intermediate layer is preferably less than one-twentieth, and even more preferably about one fiftieth, of the circumference of the storage drum. The withdrawal slide surface which is associated with the end region of the drum forms, also in this case, a portion of the surface of a cone. This portion of the surface can be smaller or larger in its radial extent than the width of the braking surface. The thread storage preferably has a stationary drum on which the turns of the thread are deposited by means of a motor-driven winding arm. Furthermore, means are provided which extend out of the inside of the drum through the surface of the drum and displace the thread turns from the winding-on side of the drum towards the withdrawal side, so that the individual turns of the thread lie, spaced apart from each other, on the surface of the drum. The maximum storable thread size is very much smaller than the width of the withdrawal slide surface and the width of the brake strip. Together with the high flexibility of the brake strip and its surface spring-action with respect to the holding member, local evasion (bending away) of the brake strip in the direction of the normal to its surface can therefore be obtained. The portion of the surface of the brake strip which does not move away due to the intermediate position of the thread remains substantially at rest, as does the holding member.

BRIEF DESCRIPTION OF THE DRAWINGS

With the above and other and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
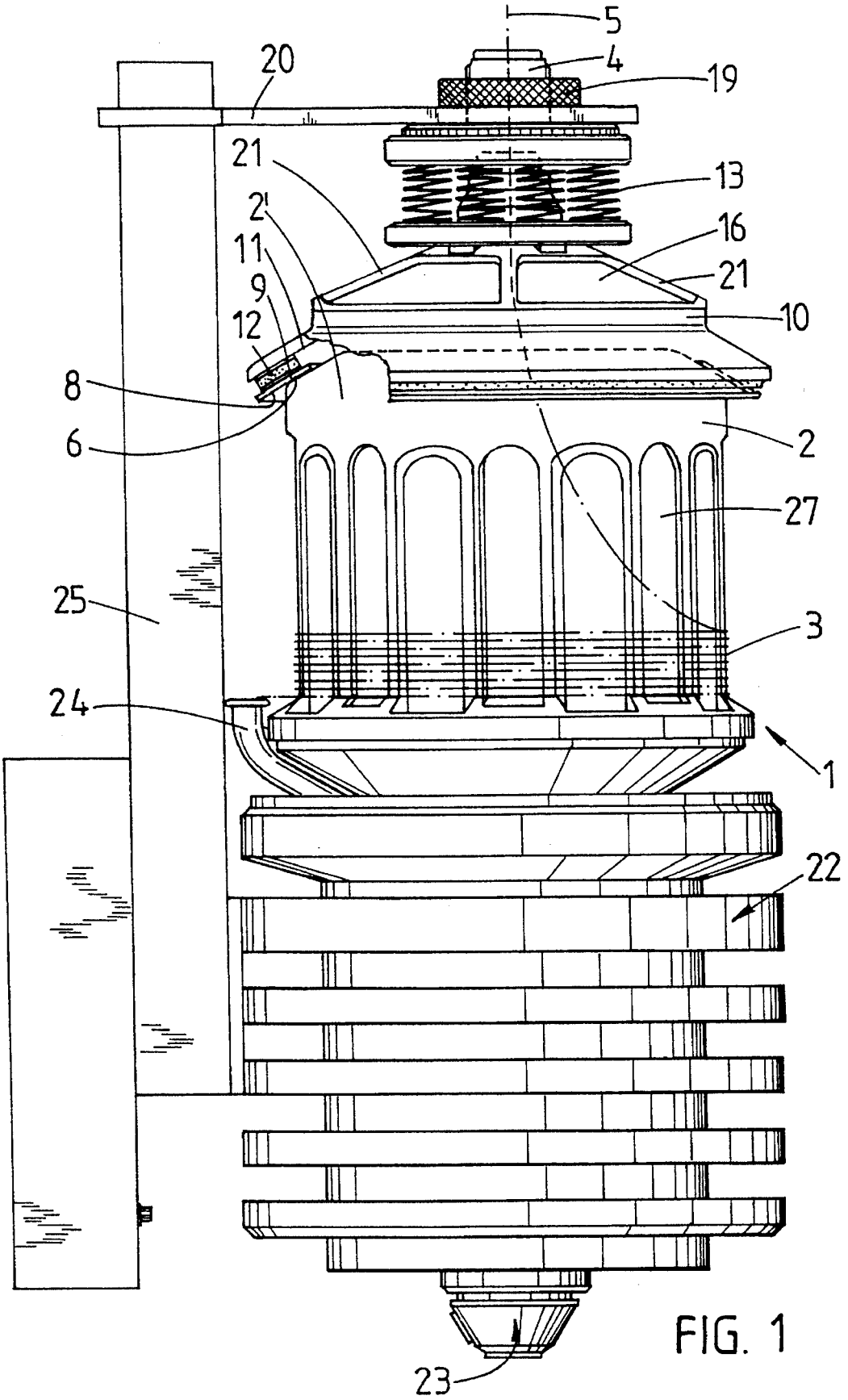
FIG. 1 is an overall view of a thread storage.
Figure 3:
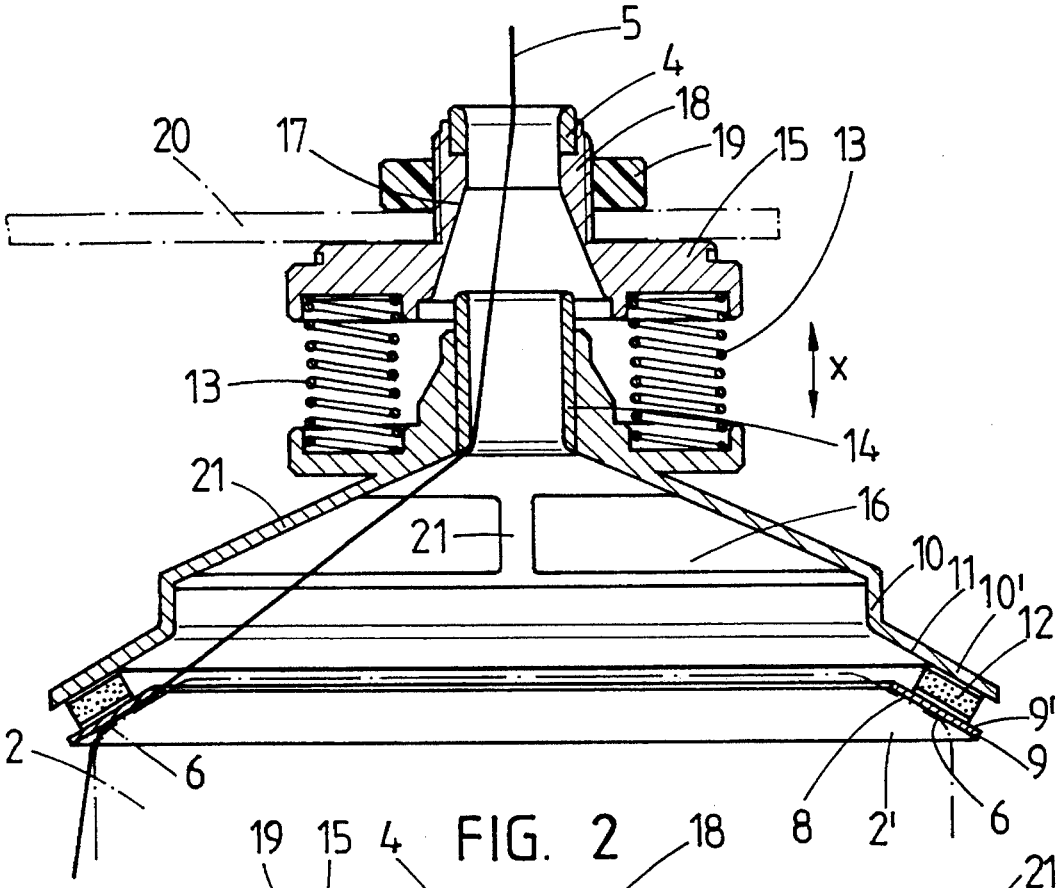
FIG. 3 is a section along the line III—III of FIG. 2 through the top region of the thread storage.
Figure 2:
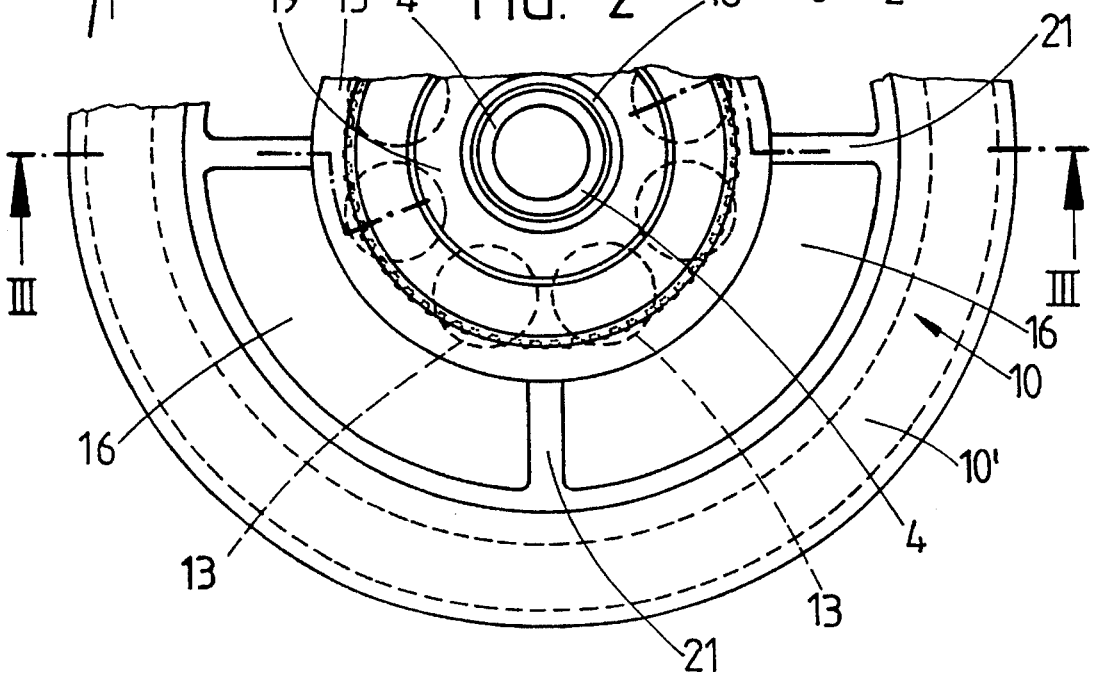
FIG. 2 is a top view of a thread storage.

The thread storage 1 has a motor housing 22 which on its lower end, has a thread introduction opening 23 which extends into a hollow shaft of the motor. The motor housing 22 is fastened on a support 25. A thread depositing arm 24 which rotates around the storage drum 2 is driven by the motor, it depositing turns of thread 3 on the surface of the storage drum 2. In the storage drum 2, there are windows 27 through which, in known manner, members extend for conveying the turns of thread 3 in the direction of withdrawal. The thread 5 is withdrawn overhead from the storage drum 2 through a thread withdrawal eye 4, which is arranged coaxial to the storage drum 2.

At the withdrawal-side end region 2' of the storage drum, the drum 2 forms a withdrawal slide surface 6. The withdrawal slide surface 6 is formed by a truncated cone by which the cylindrical surface of the Storage drum 2 passes into the end surface of the storage drum 2. This withdrawal slide surface 6 thus forms a portion of the surface of a cone. The width of the conical surface is preferably about 1 cm.

The thread 5 slides in circumferential manner on this thread slide surface 6 upon the withdrawal of the thread. In order to obtain a uniform tension of the thread upon withdrawal of the thread over the thread withdrawal surface 6, a brake surface 8 is provided which rests under spring load on the withdrawal slide surface 6. The thread is thus pulled between two spring-loaded surfaces, namely, on the one hand, the withdrawal slide surface 6 and, on the other hand, the brake surface 8. The surfaces 6 and 8 lie flat (i.e., flushly) one on the other.

The brake surface 8 is developed by the inner surface of a brake strip 9. The brake strip 9 consists of a sheet of metal which is about 0.1 mm thick or thinner and is bent into the shape of a truncated cone. The seam of the sheet-metal strip extends in this connection obliquely to the radial, so that a uniform, continuous thread-withdrawal tension is obtained. However, it is also provided that the brake strip may be, for instance, stamped or deep-drawn from a single piece. The brake strip 9 is highly flexible. It can be flexurally deflected by the application of only slight forces.

The brake strip 9 is fastened on a holding surface 11 of the holding member 10 by means of a foam body 12, which also has the shape of a truncated cone. For this purpose, the foam body 12 is bonded onto the outer surface 9' of the brake strip which is opposite the brake surface 8. The foam body 12 thus forms an elastic intermediate layer between holding member 10 and brake strip 9. The cross section of the foam body 12 is rectangular and the holding surface 11 is also developed conically and arranged parallel to the brake strip 9.

The foam body 12 can be compressed by practically its entire thickness by the action of force. The thickness of the foam body 12 is less than the width of the brake strip 9 but greater than the largest possible size of thread which can be stored, so that the spring path is sufficient for a local movement of evasion of the brake strip upon the passage of the thread. As can be noted in particular from FIG. 4, in the case of the withdrawal of a thread only that region of the brake strip 9 below which the thread 5 is directly withdrawn can move away, namely in the direction of the normal to the surface. The other regions of the brake surface 8 remain resting on the withdrawal slide surface 6. The ratio of the thickness of the intermediate layer and the circumference of the storage drum is particularly favorable for this. The spring path of the intermediate layer is less than one twentieth of the circumference of the storage drum, and in the embodiment shown it amounts to only about one fiftieth. The thread sizes are predominantly even much smaller (at least one order of magnitude) than the thickness of the intermediate layer.

The foam body 12 has a radial length of about 12 mm. The radial length of the brake strip 9 is about 15 mm, so that practically the entire outer surface of the brake strip 9 is bonded onto the foam body 12. On its other side, the foam body 12 is bonded onto the,holding surface 11 of the holding member. The holding surface 11 is formed by a partial section 10' of the holding member, which also has the shape of a truncated cone. On a cylindrical collar which extends axially in the direction of withdrawal and adjoins the partial section 10' there are formed arms 21 which leave windows 16 open between them. The arms 21 extend radially inward and axially on the withdrawal side and debouch into a mount for a thread withdrawal bushing 14 which is arranged centrally.

The thread withdrawal bushing 14 has the character of a withdrawal eye and extends into a funnel-shaped opening 17 of a fastening part 15 by which the holding member 10 is fastened on a holder 20 which is fastened to the housing. The holder 20 is, to be sure, additionally displaceable also in axial direction with respect to the holder 25. Upon its withdrawal, the thread 5 is pulled over the end edge of the thread withdrawal bushing 14. The axial position of the end edge of the thread withdrawal bushing 14, which is inwardly rounded, determines the angle with which the thread is pulled over the thread withdrawal surface 6. In order that the thread 5 leaves the withdrawal slide surface 6 tangentially, the end edge of the thread withdrawal bushing 14 lies on the imaginary extension of the cone, which forms the withdrawal slide surface 6.

Between the fastening part 15 and the movable portion of the holding member 10 which has the holding surface 11, there are provided a total of eight compression springs 13 aligned axially to the axis of the drum and arranged circumferentially around the cylindrical thread withdrawal bushing 14. By the axial displacement of the support 20 these springs can be tensioned to a greater or lesser extent, as a result of which the force with which the brake surface 8 lies against the withdrawal slide surface 6 can be adjusted. For this purpose, the fastening part 15 is displaced in the direction x. The fastening part 15 has an external thread section 18 which surrounds the funnel-shaped opening and can be screwed via a nut 19 to the support 20.

Figure 4:
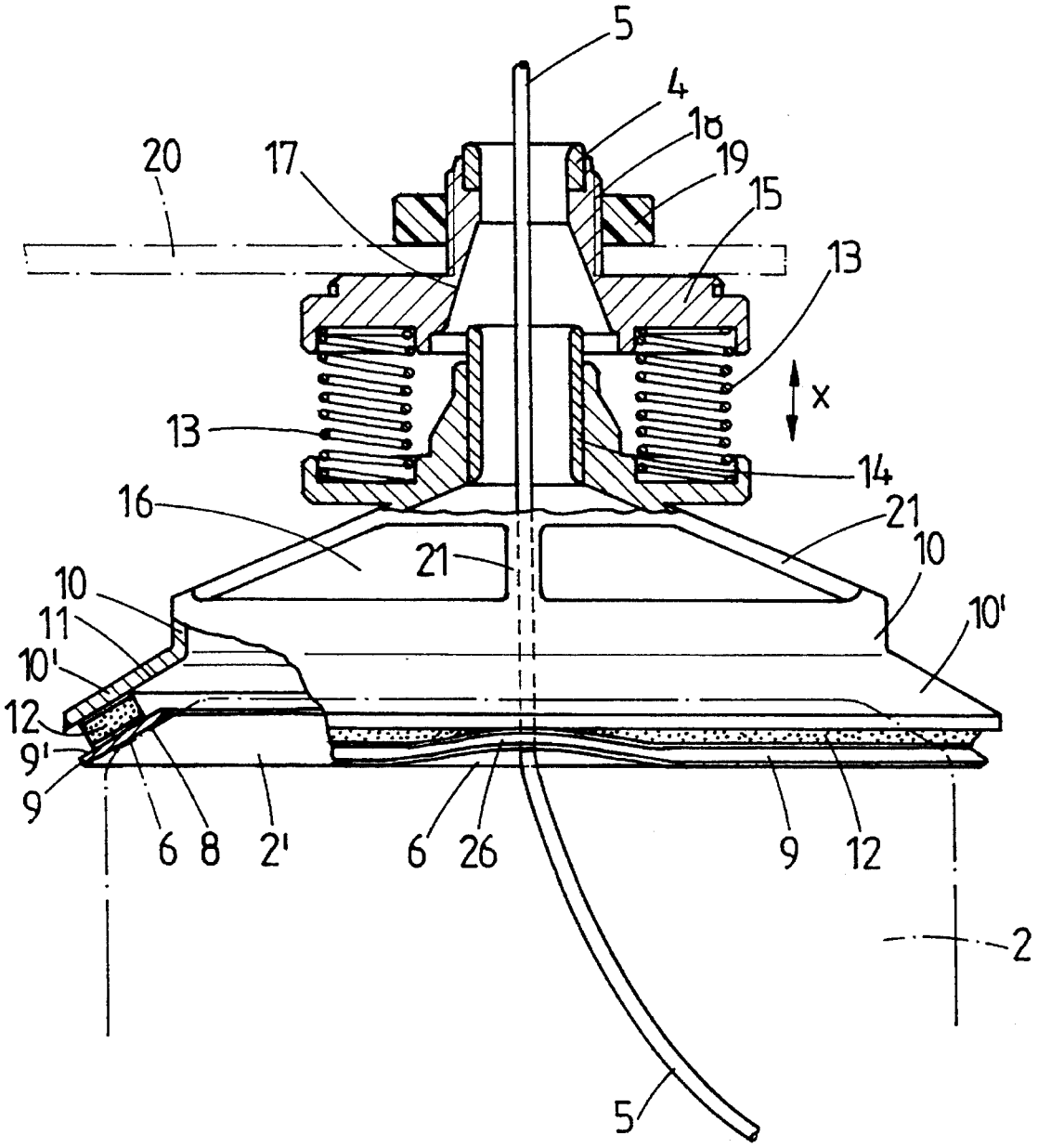
FIG. 4 is a view according to FIG. 3 upon the withdrawal of a thread.

As can be noted from FIG. 4, the partial region 26 of the brake strip 9 which receives the thread 5 between itself and the withdrawal slide surface 6 can form a bulge 26. In FIG. 4 the thread is shown in greatly exaggerated size. Upon withdrawal of the thread, this bulge 26 carries out, upon withdrawal of the thread, together with the thread 5, a circular circumferential movement around the axis of the thread storage, while the rest of the region of the brake strip 9 remains lying at rest on the withdrawal slide surface 6 in surface application with it. The foam body 12 is in this connection compressed at the corresponding places. The evasion movement of the brake strip 9 takes place in this connection in the direction of the normal to its surface, namely in the direction towards the parallelly extending holding surface 11. It is considered advantageous that, with this development, the holding member 10 is substantially not moved upon the withdrawal of the thread. Thus, there is merely a local movement of evasion of a partial region, with the formation of a bulge 26 of the brake strip 9, and this only by the amount of the diameter of the thread. While the supporting function of the brake surface 8 is taken over by the substantially immovable holding member 10, the evasion movement of the brake surface 8 is achieved by the high flexibility of the brake strip 9 and the substantially full-surface support by the spring element 12. The angle with which the frustoconical inner surface of the brake strip is inclined to the axis of the cone, which is identical to the axis of the drum, is about 60°. The angle by which the frustoconical outer surface of the storage drum, i.e. the withdrawal slide surface 6, is inclined corresponds to the angle of inclination indicated above.

Figure 5:
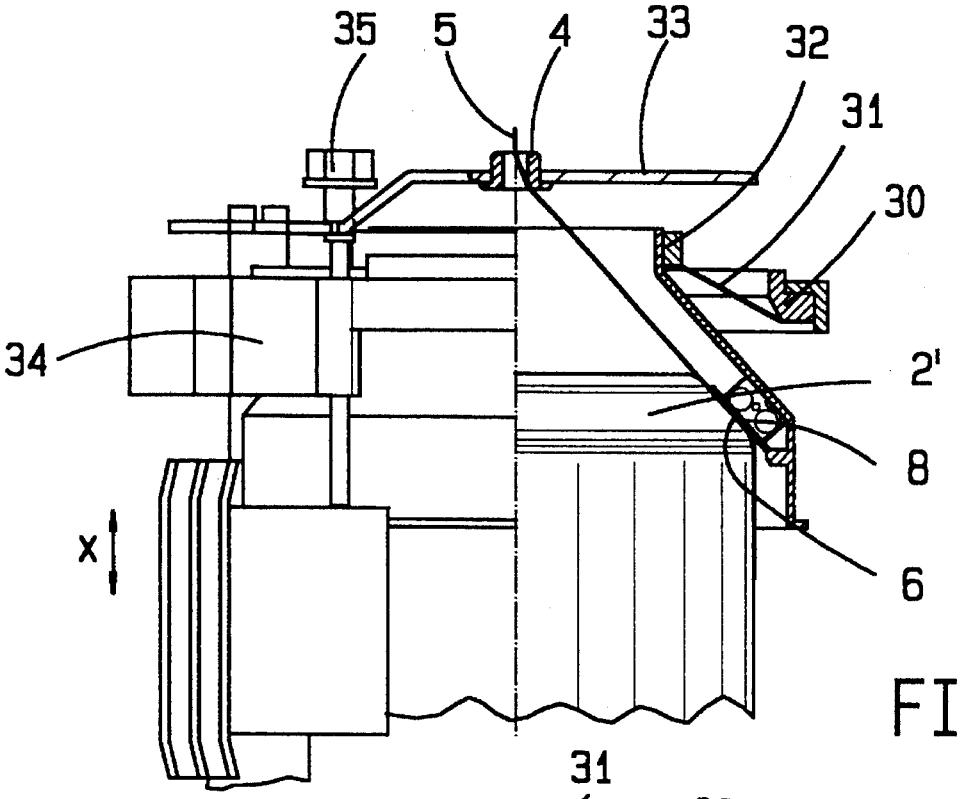
FIG. 5 shows a second embodiment of the invention with thread brake ring partially broken away.
Figure 6:
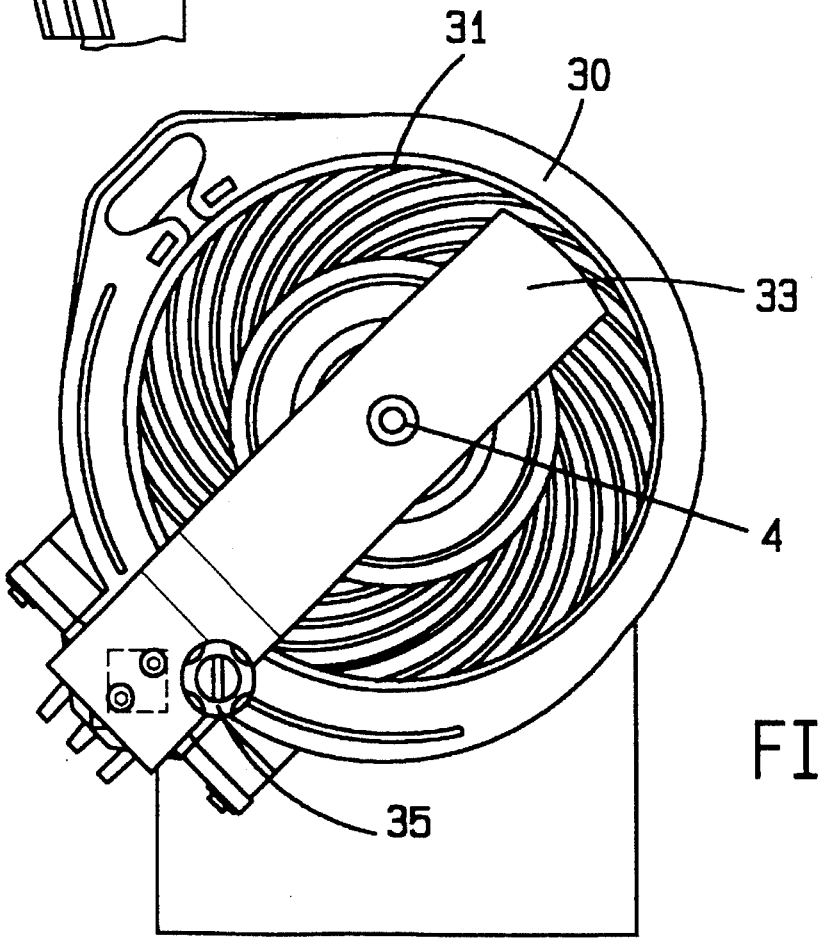
FIG. 6 is a top view of the embodiment of FIG. 5.
Figure 7:
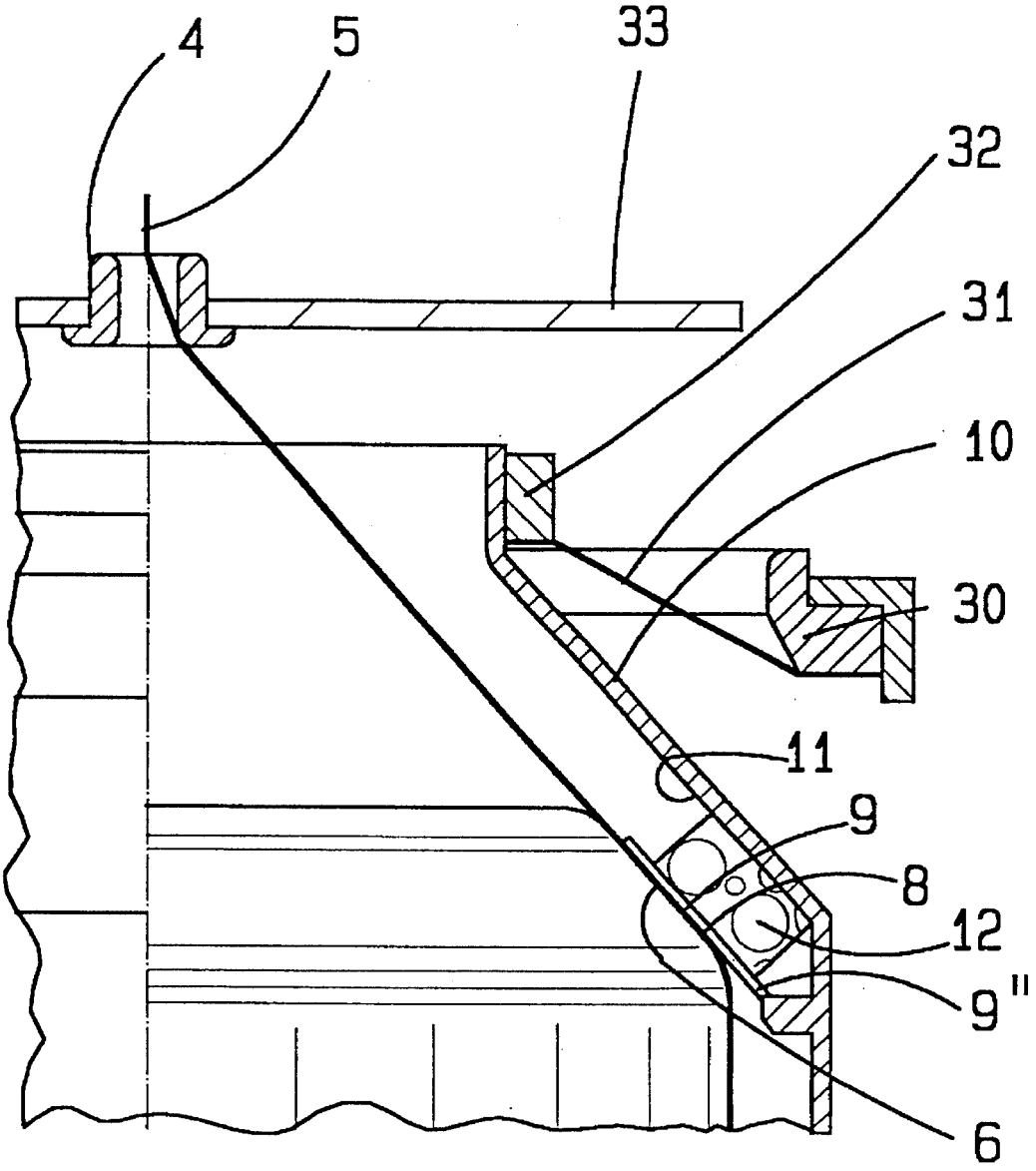
FIG. 7 is an enlarged showing of the region of the head of the thread storage of FIG. 5.

In the embodiment according to FIGS. 5 to 7, the holding member 10 is of funnel shape. The funnel opens in the direction towards the thread feed. The holding member 10 is spring-mounted with respect to a fixed ring 30 which is however displaceable in the direction x. For this purpose, spirally arranged spring blades 31 are provided which are arranged between a funnel-neck mount 32 and the annular member 30. By displacement of the annular member 30 in the direction x, the tension with which the holding member 10 is applied against the end side of the drum can be adjusted. On the inner wall of the holding member 10 there is the holding surface 11, on which an annular plastic body 12 is bonded. Parallel to the holding surface 11, but spaced from it, the brake strip 9 is bonded onto the foam body 12. The brake strip 9 has a funnel shape and, with its inner surface, forms the brake surface 8. The brake surface 8 lies flat (flushly) on a frustoconical section of the surface of the storage drum 2. This frustoconical section of the surface forms the withdrawal slide surface 6. The thread is pulled between withdrawal slide surface 6 and brake surface 8. Both surfaces consist of metal and are substantially smooth. A braking action is obtained in the manner that the brake strip 9 is pressed onto the withdrawal slide surface 6 as a result of the springlike action of the spring elements 31. Upon the pulling of the thread 5 through this thread brake, a movement of evasion takes place as the result of a slight compression of the plastic part 12.

The thread withdrawal eye 4 is arranged coaxial to the axis of the storage drum 2. The axial distance of the thread withdrawal eye 4 from the end side of the storage drum 2 is so selected that the thread 5 leaves the withdrawal slide surface 6 parallel to the tangent to the surface. The thread accordingly always travels on the imaginary extension of the conical surface of the withdrawal slide surface 6.

As can be noted in particular from FIG. 7, an outer edge region 9" of the brake strip 9 extends beyond the circumferential contour of the cylindrical storage drum 2. The cylindrical section of the storage drum 2 passes via a rounding into the frustoconical withdrawal slide surface 6. As a result of the protrusion 9' an annular wedge is formed into which the thread enters into the thread brake. The thread thus does not travel against an edge, which results in less stressing of the thread.

The force with which the brake strip 9 rests on the withdrawal slide surface 6 is produced, as stated, by an axial displacement of the holding ring 30. For this, an adjustment screw 35 is provided, which is fastened on an arm 33 which at the same time bears the thread withdrawal eye 4.

I claim:

1. A thread storage comprising a substantially cylindrical storage drum adapted to receive and deliver circumferentially deposited turns of thread, a central, thread withdrawal eye through which the thread is adapted to pass for withdrawal overhead of the thread, a frustoconical withdrawal slide surface on a withdrawal-side end region of the drum, a continuous, frustoconical brake strip of flexible material, said brake strip having an inner side comprising a frustoconical braking surface resting on said frustoconical withdrawal slide surface, the thread being adapted to pass between said braking surface and said frustoconical withdrawal slide surface, and elastic means engagingly supporting the other side of said brake strip, the frustoconical braking surface of the brake strip complementarily resting on said frustoconical withdrawal slide surface with frustoconical surface-to-surface flush engagement, both said braking surface and said frustoconical withdrawal slide surface comprising continuously substantially smooth surfaces which flushly engage each other thereby permitting the thread to slide between said slide and braking surfaces during the withdrawal of the thread through the withdrawal eye, and flexibility of the brake strip in combination with the elastic means permitting the brake strip to lift off from the slide surface in a region where the thread slides between said surfaces while the remainder of said surfaces are in flush engagement.

2. A thread storage according to claim 1, wherein the thread in its withdrawal condition extends tangentially to the withdrawal slide surface.

3. A thread storage according to claim 1, wherein the thread withdrawal eye lies in the region of a theoretical tip of the frustoconical withdrawal slide surface.

4. The thread storage according to claim 1, wherein said brake strip comprises a metal foil which is smooth on said inner side.

5. The thread storage according to claim 1, wherein the frustoconical braking surface of the brake strip has the same frustoconical angle as that of the frustoconical withdrawal slide surface.

6. The thread storage according to claim 1, wherein said cylindrical storage drum has a cylindrical surface and a rounding surface between the frustoconical withdrawal slide surface and said cylindical surface, and said brake strip has an outer end which projects beyond the cylindrical storage drum adjacent said rounding surface of the drum, the outer end of the brake strip and the rounding surface forming an annular wedge into which said thread enters, said annular wedge funneling entry of the thread to between the braking surface and the withdrawal slide surface, thereby minimizing stressing of the thread.

7. The thread storage according to claim 1, wherein both said braking and slide surfaces are made of metal.

8. The thread storage according to claim 1, wherein said brake strip is thin.

9. The thread storage according to claim 8, wherein the thickness of the brake strip is less than substantially 0.1 mm.

10. The thread storage according to claim 1, wherein said frustoconical braking surface and said frustoconical withdrawal slide surface permanently flushly engage each other independent of tension of said thread.

11. A thread storage comprising a substantially cylindrical storage drum adapted to receive and deliver circumferentially deposited turns of thread, a central thread withdrawal eye for withdrawal overhead of the thread, a frustoconical withdrawal slide surface on a withdrawal-side end region of the drum, a frustoconical brake strip of flexible material, a braking surface resting under spring load on said frustoconical withdrawal slide surface, said braking surface comprises an inner side of said frustoconical brake strip flexible material, the braking surface of the brake strip rests flushly on said frustoconical withdrawal slide surface a holding member having a holding surface, an intermediate layer of elastic material, and the brake strip is connected with said holding surface of said holding member by said intermediate layer of elastic material.

12. A thread storage according to claim 11, wherein the intermediate layer is formed of a foam body which is substantially of rectangular frustoconical shape in cross section.

13. A thread storage according to claim 12, wherein the radial width of the foam body is less than the radial width of the brake strip.

14. A thread storage according to claim 11, wherein the thickness of the intermediate layer is less than the width of the brake strip but greater than the largest possible size of thread which can be stored.

15. A thread storage according claim 11, wherein a spring path of the intermediate layer is less than one twentieth of the circumference of the storage drum.

16. The thread storage according to claim 15, wherein a spring path of the intermediate layer is less than one fiftieth of the circumference of the storage drum.

17. A thread storage according to claim 11, further comprising spring means for spring-biasing the holding member in axial direction of the storage drum.

18. The thread storage according to claim 11, wherein said intermediate layer is fustoconical and complementarily engages said frustoconical brake strip with substantially full surface support.

19. A thread storage comprising a substantially cylindrical storage drum adapted to receive and deliver circumferentially deposited turns of thread, a central thread withdrawal eye for withdrawal overhead of the thread, a frustoconical withdrawal slide surface on a withdrawal-side end region of the drum, a frustoconical brake strip of flexible material, a braking surface resting under spring load on said frustoconical withdrawal slide surface, said braking surface comprises an inner side of said frustoconical brake strip of flexible material, the braking surface of the brake strip rests flushly on said frustoconical withdrawal slide surface, both said surfaces comprising continuous and substantially smooth surfaces which permanently flushly engage each other independent of tension of said thread, the brake strip is formed by a thin metal strip which is smooth on said inner side.

20. The thread storage according to claim 19, wherein the thickness of the metal strip is less than substantially 0.1 mm.

21. The thread storage according to claim 19, wherein the thread in its withdrawal condition extends tangentially to the withdrawal slide surface.

22. A thread storage comprising a substantially cylindrical storage drum adapted to receive and deliver circumferentially deposited turns of thread, a central thread withdrawal eye for withdrawal overhead of the thread, a frustoconical withdrawal slide surface on a withdrawal-side end region of the drum, a thin frustoconical brake strip of flexible material having a frustoconical braking surface comprising an inner side of said frustoconical brake strip, first spring means for biasing said braking surface with spring load for resiliently engaging said braking surface on said frustoconical withdrawal slide surface, with the braking surface of the brake strip flushly resiliently engaging said frustoconical withdrawal slide surface, both said surfaces comprising continuous and substantially smooth surfaces, second spring means for spring-biasingly supporting said brake strip via said first spring means against said withdrawal slide surface, said second spring means having a axial spring force in axial direction of said drum with which force the braking surface of said brake strip is supported on the withdrawal slide surface, and said second spring means for adjusting the axial spring force of said second spring means.

* * * * *

UNITED STATES PATENT AND TRADEMARK OFFICE

CERTIFICATE OF CORRECTION

PATENT NO. : 5,546,994

DATED : August 20, 1996

INVENTOR(S) : Alberto G. Sarfati

It is certified that error appears in the above-identified patent and that said Letters Patent is hereby corrected as shown below:

On the cover page insert:

--[30] Foreign Application Priority Data

April 13, 1994 [DE] Germany ....G 9406102.5--

Signed and Sealed this

Thirteenth Day of May, 1997

Bruce Lehman

*Attest:*

BRUCE LEHMAN

*Attesting Officer*

*Commissioner of Patents and Trademarks*